US009056399B2

(12) United States Patent
Jones

(10) Patent No.: US 9,056,399 B2
(45) Date of Patent: Jun. 16, 2015

(54) UTILTY KNIFE

(76) Inventor: Ralph Jones, Tallahassee, FL (US)

( * ) Notice: Subject to any disclaimer, the term of this patent is extended or adjusted under 35 U.S.C. 154(b) by 259 days.

(21) Appl. No.: 13/486,534

(22) Filed: Jun. 1, 2012

(65) Prior Publication Data

US 2012/0304471 A1 Dec. 6, 2012

Related U.S. Application Data

(60) Provisional application No. 61/519,899, filed on Jun. 1, 2011.

(51) Int. Cl.
*B26B 27/00* (2006.01)
*B26B 5/00* (2006.01)

(52) U.S. Cl.
CPC ..... *B26B 27/007* (2013.01); *B26B 5/001* (2013.01)

(58) Field of Classification Search
CPC ..... B26B 5/001; B26B 27/007
USPC ..... 30/162, 296.1, 298
See application file for complete search history.

(56) References Cited

U.S. PATENT DOCUMENTS

| | | | | |
|---|---|---|---|---|
| 79,709 | A | 7/1868 | Stewart | |
| 126,565 | A * | 5/1872 | Mitchell | 30/123.5 |
| 972,187 | A * | 10/1910 | Hanson | 30/298 |
| 1,315,503 | A | 9/1913 | Hughes | |
| 1,091,757 | A * | 3/1914 | Owen et al. | 30/298 |
| 1,190,052 | A | 7/1916 | Welander | |
| 1,204,663 | A * | 11/1916 | Hockenhull | 30/123.5 |
| 1,512,943 | A * | 10/1924 | Martineau | 7/121 |
| 1,523,901 | A * | 1/1925 | Rohrich | 30/123.5 |
| 1,547,863 | A * | 7/1925 | Dulin | 29/270 |
| 1,678,570 | A * | 7/1928 | Longcor | 30/298 |
| 1,881,368 | A * | 10/1932 | Kriege et al. | 30/123.5 |
| 2,129,218 | A * | 9/1938 | Kelly | 30/123.5 |
| 2,353,557 | A * | 7/1944 | Guthrie | 30/298 |
| 2,989,807 | A * | 6/1961 | Florence | 30/151 |
| 3,587,591 | A * | 6/1971 | Satterwhite | 606/125 |
| 3,981,526 | A | 9/1976 | Lundqvist | |
| 4,149,296 | A | 4/1979 | Stanford | |
| 4,339,878 | A * | 7/1982 | Tozzi | 30/298 |
| 4,976,032 | A | 12/1990 | Battaglia | |
| 5,058,278 | A | 10/1991 | Colvin | |
| 5,325,596 | A * | 7/1994 | Baker | 30/298 |
| 6,298,487 | B1 | 10/2001 | Mayhew | |
| 6,298,489 | B1 * | 10/2001 | Cox | 2/161.6 |
| 8,375,588 | B2 * | 2/2013 | Gringer | 30/2 |
| 2010/0236077 | A1 | 9/2010 | Shirey | |
| 2011/0113631 | A1 * | 5/2011 | Zdunek | 30/34.05 |

FOREIGN PATENT DOCUMENTS

| | | | |
|---|---|---|---|
| GB | 2 426 946 | * | 12/2006 |

* cited by examiner

*Primary Examiner* — Hwei C Payer
(74) *Attorney, Agent, or Firm* — Adrienne Love

(57) ABSTRACT

The utility knife device generally comprises a sheath, covering a portion of the user's hand and a blade housing which attach together at a connection point. The blade housing is made up of a casing which preferably encloses the user's index finger, a blade housed within the casing and a trigger which extends out of the casing and manipulates the blade. The blade is capable of extending outward from the casing being held in place for use. The blade is also capable of automatically retracting within the casing so that the blade is not exposed.

3 Claims, 9 Drawing Sheets

UTILTY KNIFE

CROSS-REFERENCES TO RELATED APPLICATIONS

This is a non-provisional application which claims the benefit of an earlier-filed provisional application pursuant to 37 C.F.R. §1.53(c). The earlier application was filed on Jun. 1, 2011, and was assigned U.S. Ser. No. 61/519,899.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices for utility knives. More specifically, the invention comprises a retractable utility knife attachable to the hand of a user.

2. Description of the Related Art

Many tasks require use of a razor blade. Stockroom jobs are among many jobs which often require an individual to carry a razor blade or cutting knife on his/her person. A stockroom worker, such as a grocery store stocker, is required to open multiple cardboard boxes throughout the day. In order to open a box, the worker must retrieve the cutting tool from his/her pocket, slice the box and return the tool to his/her pocket or belt. The worker is unable to move quickly from box to box and can leave the cutting tool behind if she/he sets it down. Additionally, the cutting tool is often left exposed and can result in accidental injury to the worker's hand or body.

There are many cutting tools that can be used to open a box. However, no cutting tool is capable of being attached to a user's hand in a safe manner such that the user can expose and retract a blade with the use of one hand. Additionally, the blade is capable of locking in place to simply and efficiently cut the likes of a cardboard box open.

Therefore what is needed is a utility knife which allows simple and efficient slicing of an object, such as a cardboard box. The present invention achieves this objective, as well as others that are explained in the following description.

BRIEF SUMMARY OF THE INVENTION

The present invention comprises a utility knife device which fits over and is thereby attached to a user's hand. The utility knife device is generally comprised of a sheath, covering a portion of the user's hand and a blade housing which attach together at a connection point. The blade housing is made up of a casing which preferably encloses the user's index finger, a blade housed within the casing and a trigger which extends out of the casing and manipulates the blade. The blade is capable of extending outward from the casing for use and retracting within the casing so that the blade is not left exposed.

REFERENCE NUMERALS IN THE DRAWINGS

| | | | |
|---|---|---|---|
| 10 | utility knife device | 12 | sheath |
| 14 | protective cover | 16 | tip cover |
| 18 | blade housing | 20 | casing |
| 22 | trigger | 24 | lock track |
| 26 | blade | 28 | wrist portion |
| 30 | soft cover | 32 | connection point |
| 34 | strap | 36 | knuckle portion |
| 38 | lock pole | 40 | pole spring |
| 42 | blade tray | 44 | groove |
| 46 | tray floor | 48 | strap opening |
| 50 | alternate embodiment | 52 | series of straps |
| 54 | alternate blade housing | 56 | channels |
| 58 | positioning slope | 60 | spring |
| 62 | slide channel | | |

DETAILED DESCRIPTION OF THE INVENTION

Figure 1:
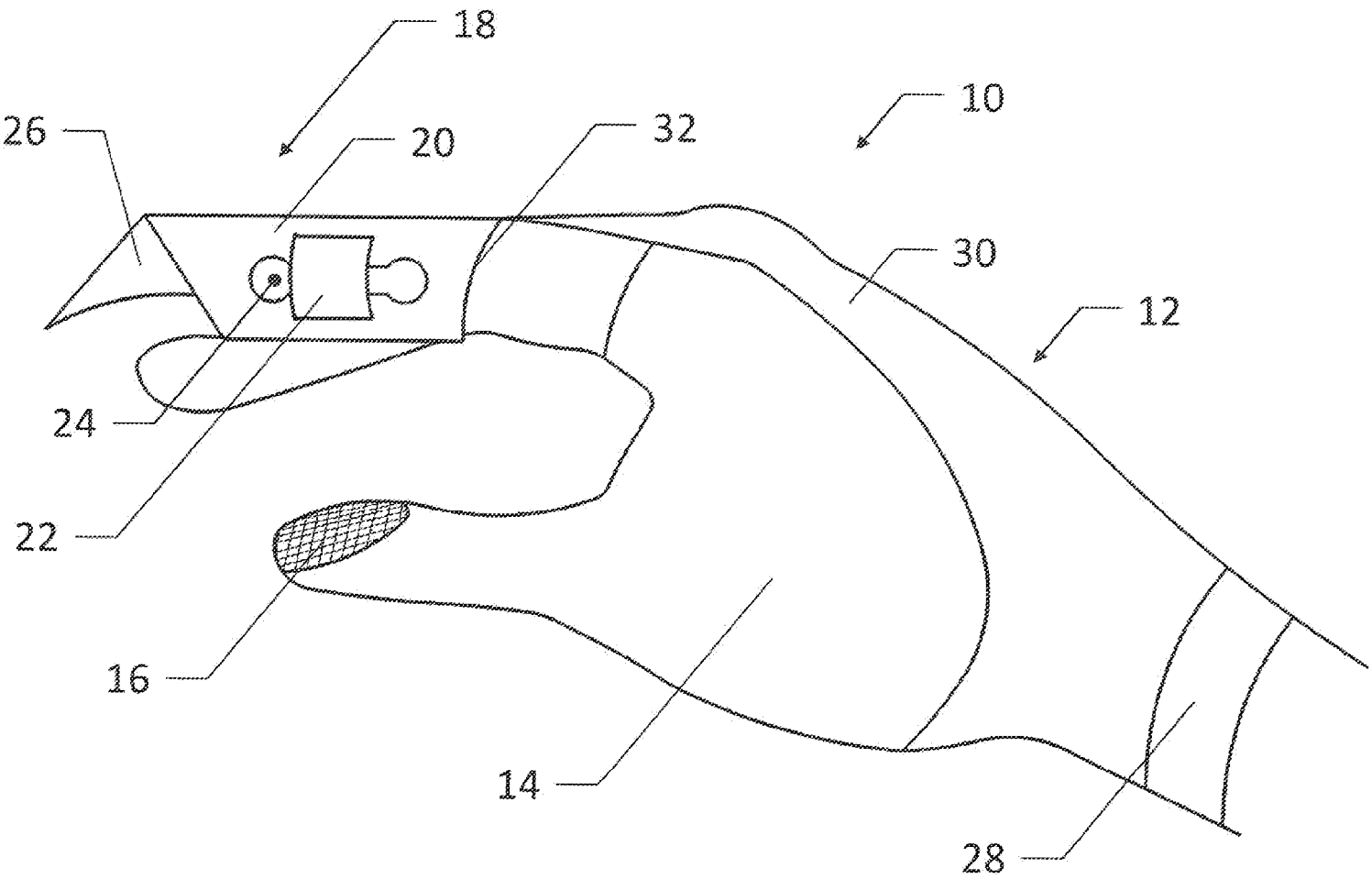
FIG. 1 is a perspective view, showing the present utility knife device with the blade exposed.

FIG. 1 illustrates the present invention in the preferred embodiment. The utility knife device 10 consists of sheath 12 connected to blade housing 18. Blade housing 18 includes casing 20 and trigger 22. Casing 20 is attached to sheath 12 at connection point 32. Trigger 22 is movably connected to blade 26 housed within casing 20. Blade housing 18 can be any shape which fits around a user's finger, preferably the user's index finger. Additionally, blade housing 18 can be made of any material which is capable of safely securing a blade inside. Blade housing 18 is connected to sheath 12 by any known method of secure connection at connection point 32. Examples of connection methods between two materials include the use of a heat seal, glue, chemical seal or threading the materials of blade housing 18 and sheath 12 together. Sheath 12 is preferably a glove which covers the user's hand and is held in place by wrist portion 28. Wrist portion 28 can be made of elastic or include a strap for attachment by way of a hook and loop connection, such as Velcro®.

Sheath 12 can be made up of one sturdy material but is preferably comprised of a protective cover 14 and soft cover 30. Protective cover 14 is made of a material which is resistant to puncturing but malleable enough to bend. Soft cover 30 covers the remainder of the hand and can be made of a less-versatile material, such as cotton, vinyl or polyester. A tip cover 16 is optionally added to the user's thumb opposite the blade 26. Tip cover 16 is made up of a hardened material which is very difficult or impossible to penetrate with blade 26.

In the present illustration blade 26 is shown extending from casing 20 such that the user can make a cut with blade 26. An optional shield located near or around blade 26 can be added as an additional safety feature. Blade 26 is preferably held into place outside of blade housing 18 when pressure is put on trigger 22 by the user. The current view shows trigger 22 in the middle position of lock track 24. When the user releases trigger 22 it is preferable that the blade 26 springs back into blade housing 18 for safety purposes. This feature requires that the user provide some pressure on trigger 22 to operate blade 26. However, note that in the alternative the blade 26 can be designed to lock into place in its current position in lock track 24, as further defined, such that the user is not required to place pressure on trigger 22 when making a cut.

Figure 8:
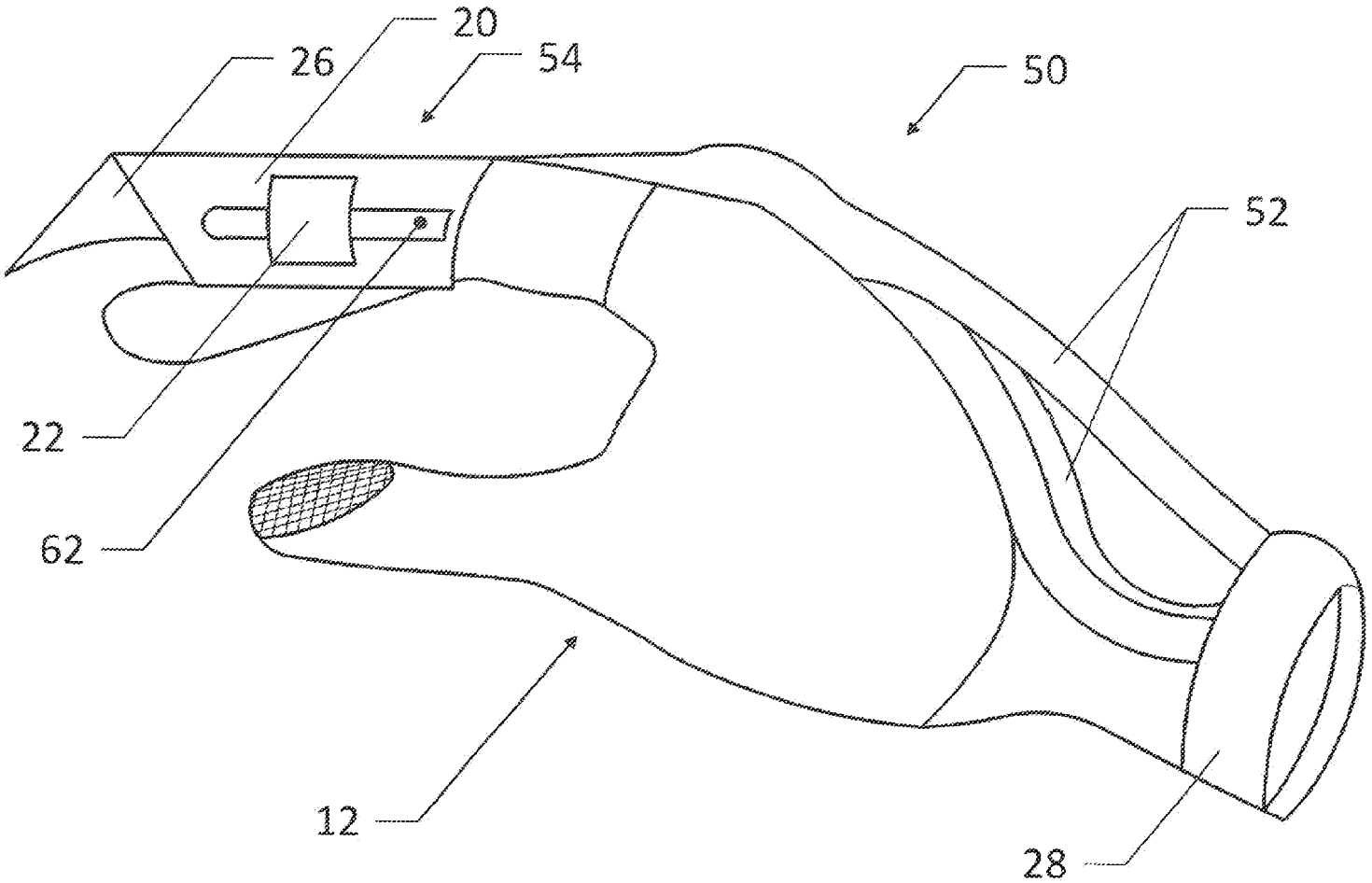
FIG. 8 is a perspective view, showing an alternate embodiment of the present invention.
Figure 9:
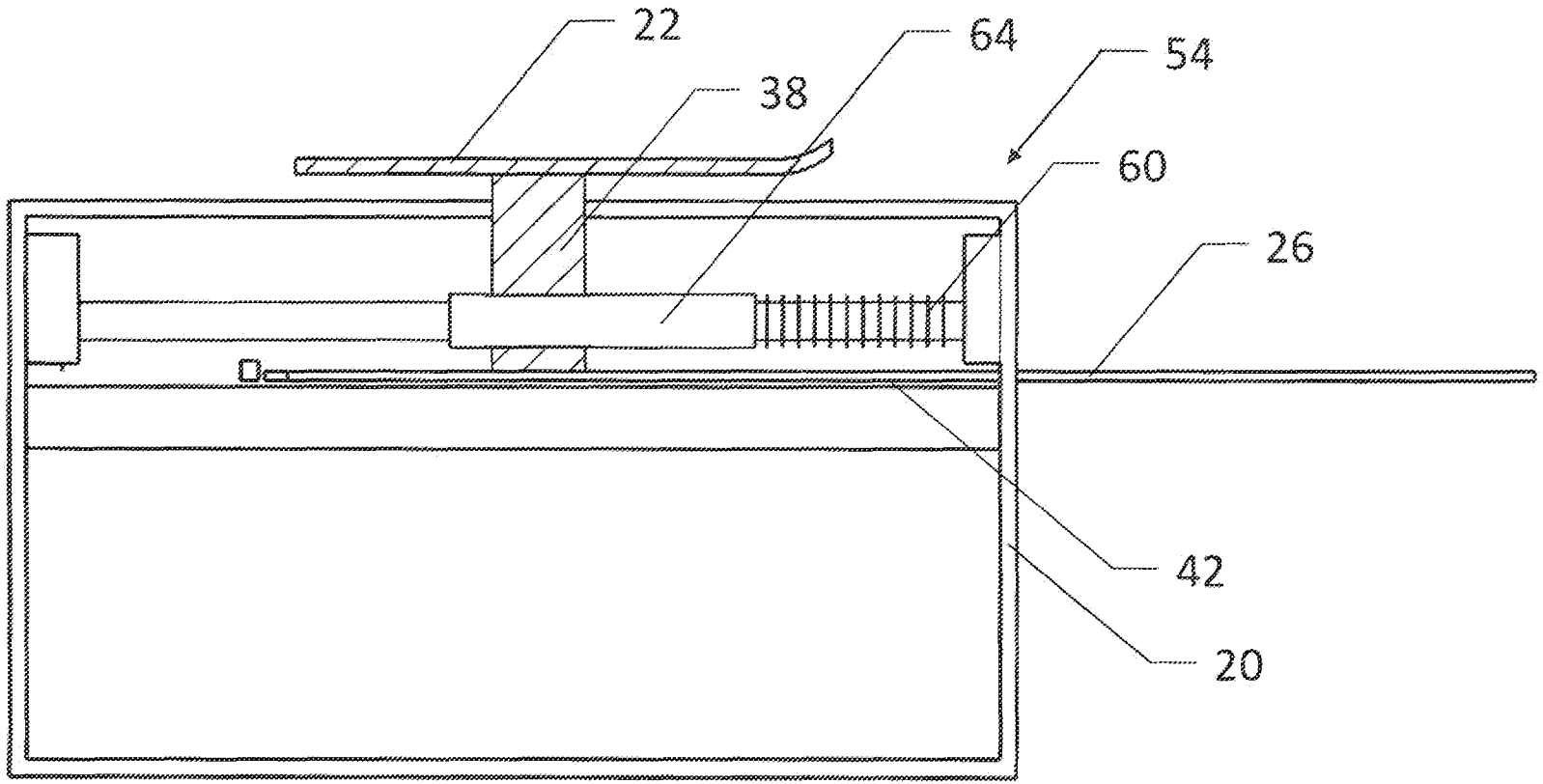
FIG. 9 is a cross-section view showing the an alternate blade housing of the present invention.

Blade 26 is shown as a razor blade which is curved or hooked downward so that the user can easily extend blade 26 by slightly depressing trigger 22 and moving trigger 22 into position. However, the shape of blade 26 is not limited to the illustrated design. Instead, the blade can be designed in any manner which allows the user to make an appropriate cut. Once held in place or locked in place, blade 26 can be used to make a cut, such as slicing open a cardboard box or cutting a carpet for use. Trigger 22 is purposefully positioned on casing 20 along the side of index finger for the purpose of allowing the user to—with one hand action—extend and use blade 26. After activating trigger 22 blade 26 would either spring back into position within blade housing 18 (as illustrated in FIGS. 8 and 9) or the user would retract blade by placing pressure on trigger 22. In either method of retracting the blade 26, the user can easily reach trigger 22 with his/her thumb tip to manipulate trigger 22 into the appropriate position.

Figure 2:
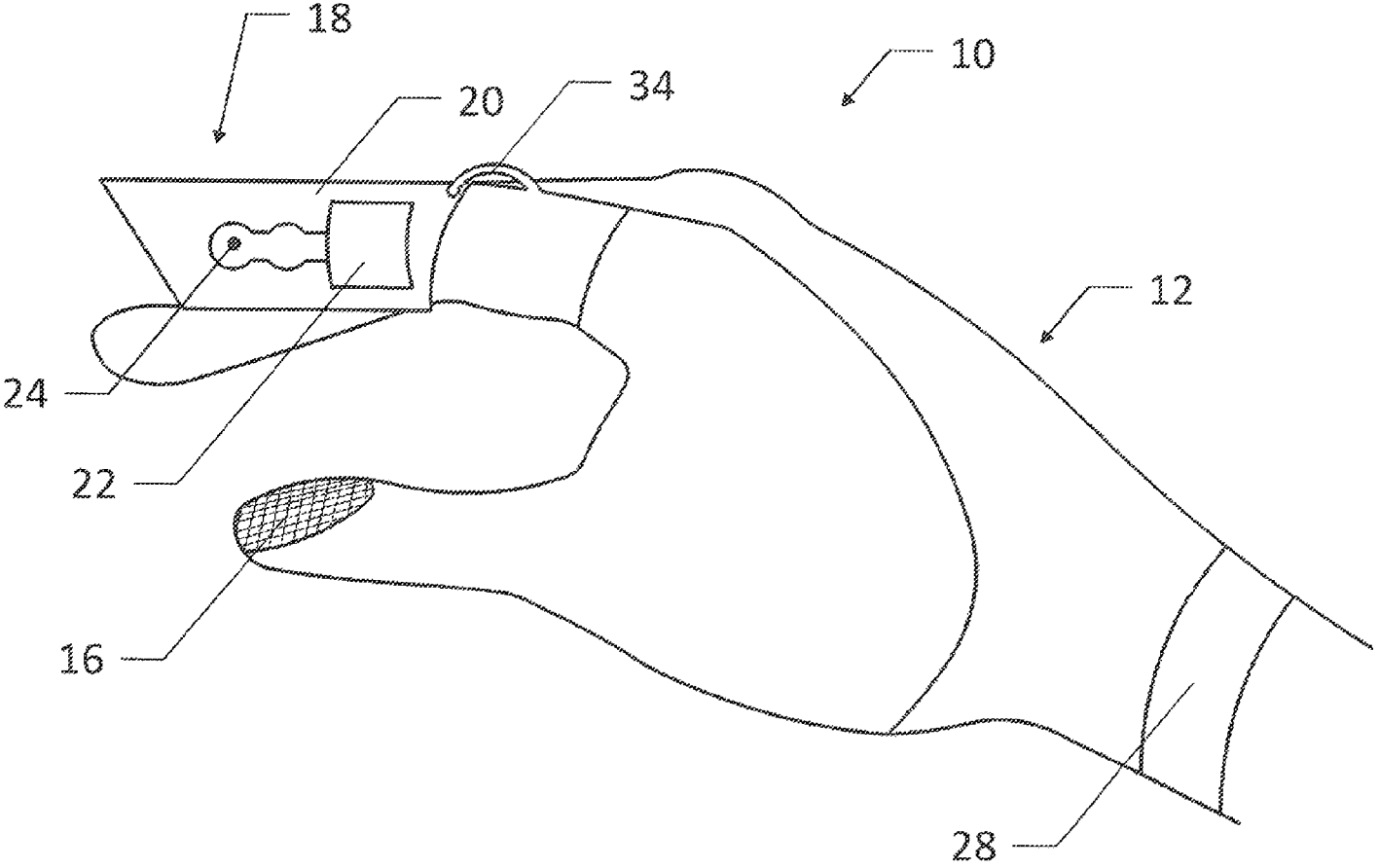
FIG. 2 is a perspective view, showing the present utility knife device with the blade retracted.

FIG. 2 illustrates the present utility knife 10 with the blade 26 (not shown) fully retracted within blade housing 18. Trigger 22 is shown in the initial position on lock track 24. When the trigger is in this position, the user can easily carry the blade in an accessible but safe manner. The user is still able to work on tasks that do not require the use of the blade. A strap 34 is shown attaching casing 20 to sheath 12. However, the connection between casing 20 and sheath 12 can consist of multiple straps or any other type of attachment or connection method, as discussed above.

Figure 3:
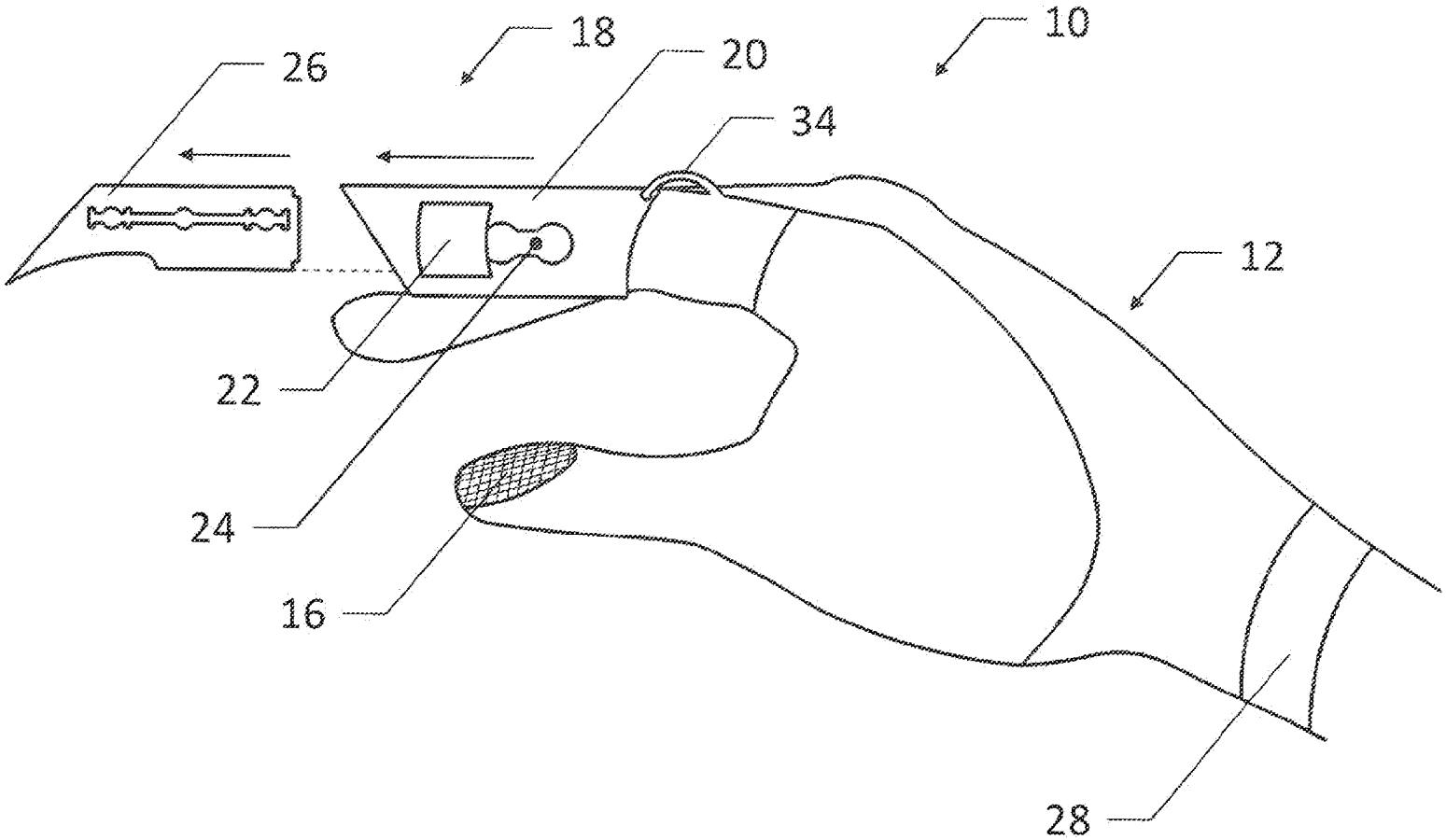
FIG. 3 is a perspective view, showing the present utility knife ejecting the blade.

As illustrated in FIG. 3, blade 26 can be ejected from casing 20 to easily change a dull or broken blade. Arrows illustrate the ejection of blade 26 from casing 20. In the preferable method, trigger 22 is pushed to the last position on lock track 24. Trigger 22 lifts slightly upward to release blade 26 when in the illustrated position on lock track 24. Any known method of extracting an old blade from blade housing 18 can be used. As an example, the blade housing 18 could be opened and the blade 26 changed in that manner as well.

Figure 4:
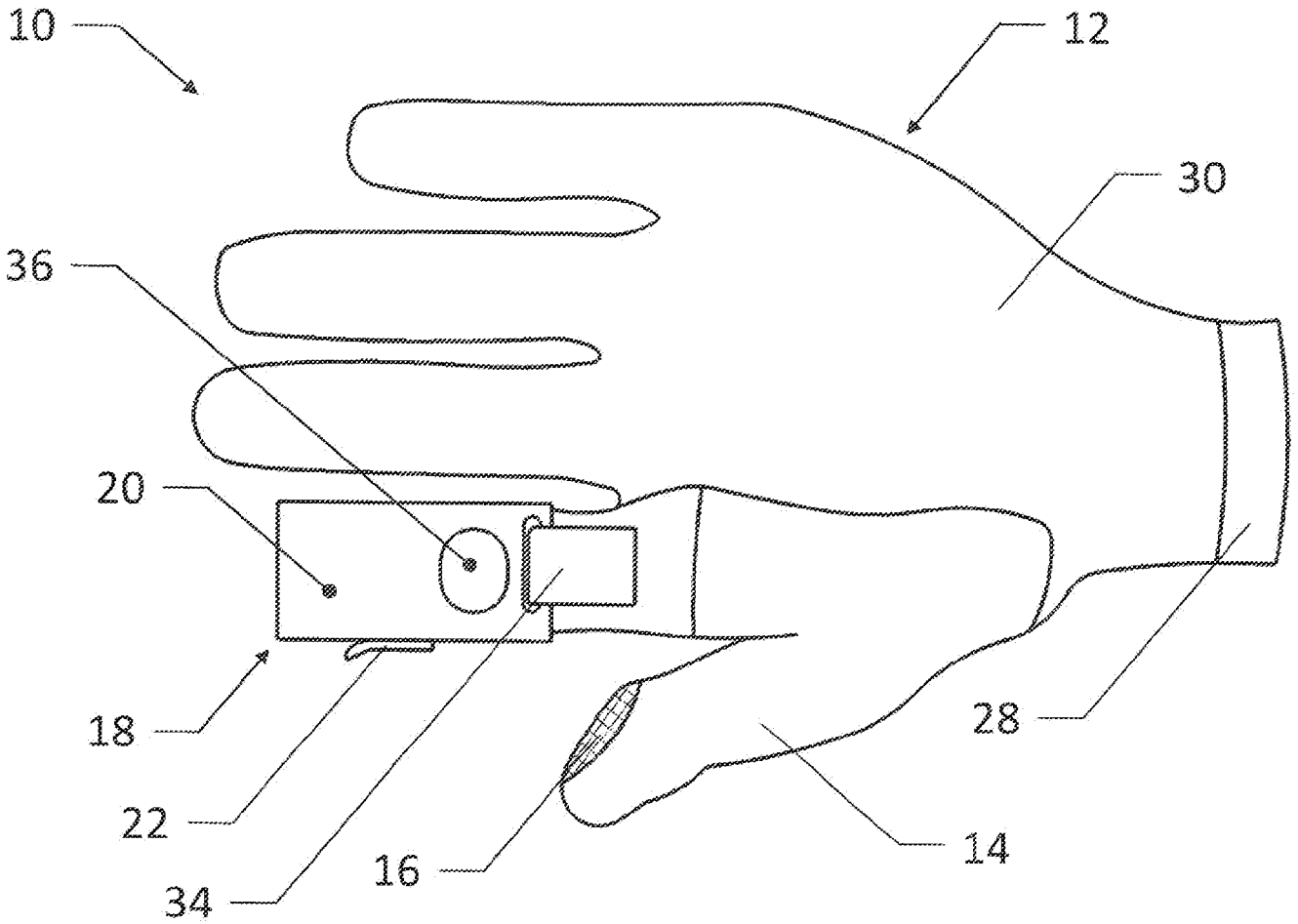
FIG. 4 is a perspective view, showing the present utility knife from above.

FIG. 4 shows a top view of the present utility knife device 10. The user's hand is generally covered by the device 10. Blade housing 18 encloses the index finger of the user. It is desirable that the full index finger is not enclosed by blade housing 18, but instead, the index finger is covered from the tip to the middle joint, thereby allowing the finger to bend. However, the device should not be limited to this functionality. Instead blade housing 18 may cover the entire finger and/or portions of sheath 12. Additionally, although blade housing 18 appears non-malleable, blade housing could be made of a hardened, semi-malleable material to allow some limited movement.

In one embodiment a cut out or grip is provided at the user's knuckle. Knuckle portion 36, as shown, is simply an opening in casing 20 which allows additional room to bend the index finger. The opening can be optionally covered with fabric. However, knuckle portion 36 could also be a grip, made of material which provides frictional engagement with the user's knuckle, located on the inside of the casing 20. The optional grip would allow additional stability to grip and hold the blade steady while making a cut.

Figure 5:
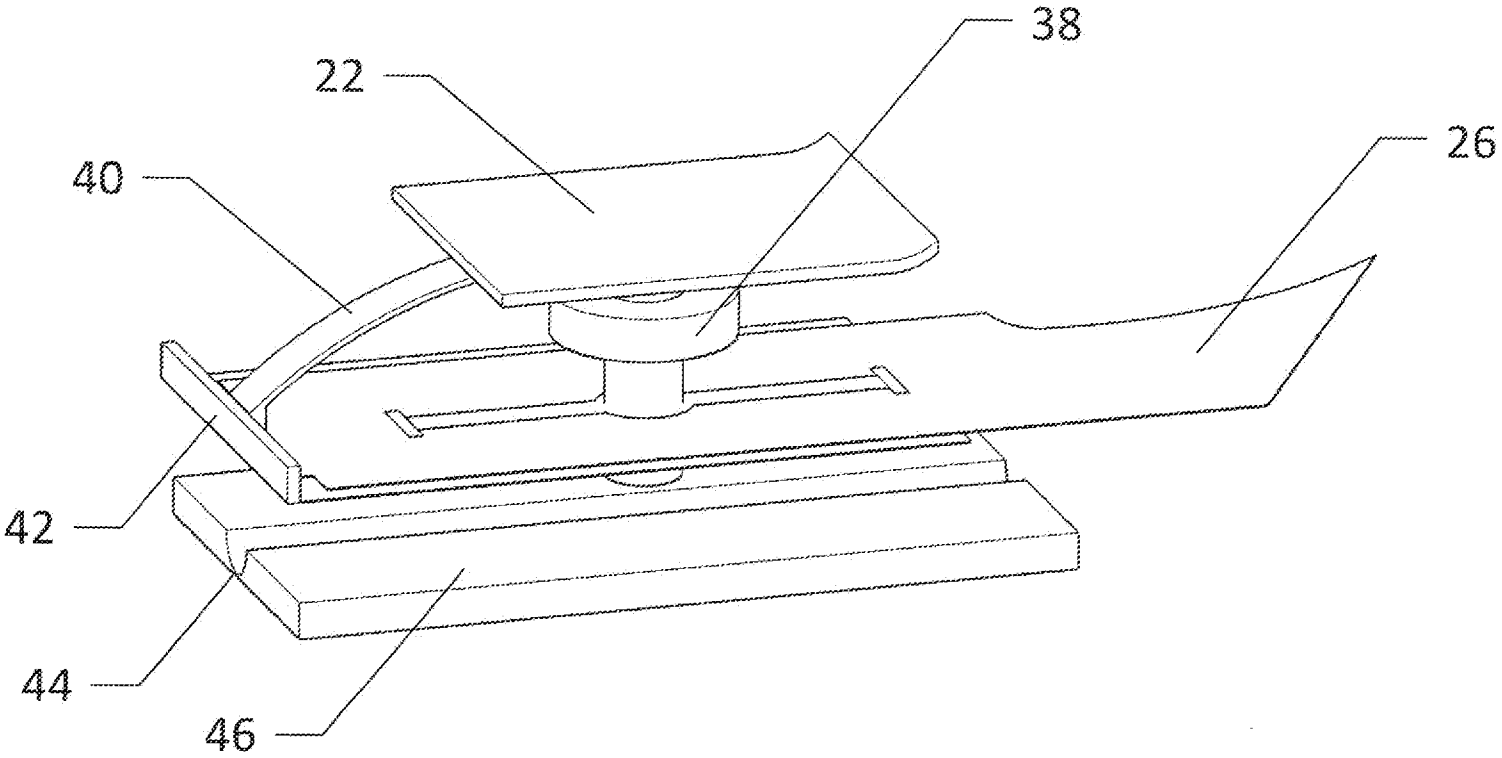
FIG. 5 is an exploded view, showing several component parts of the assembly within the blade housing.
Figure 6:
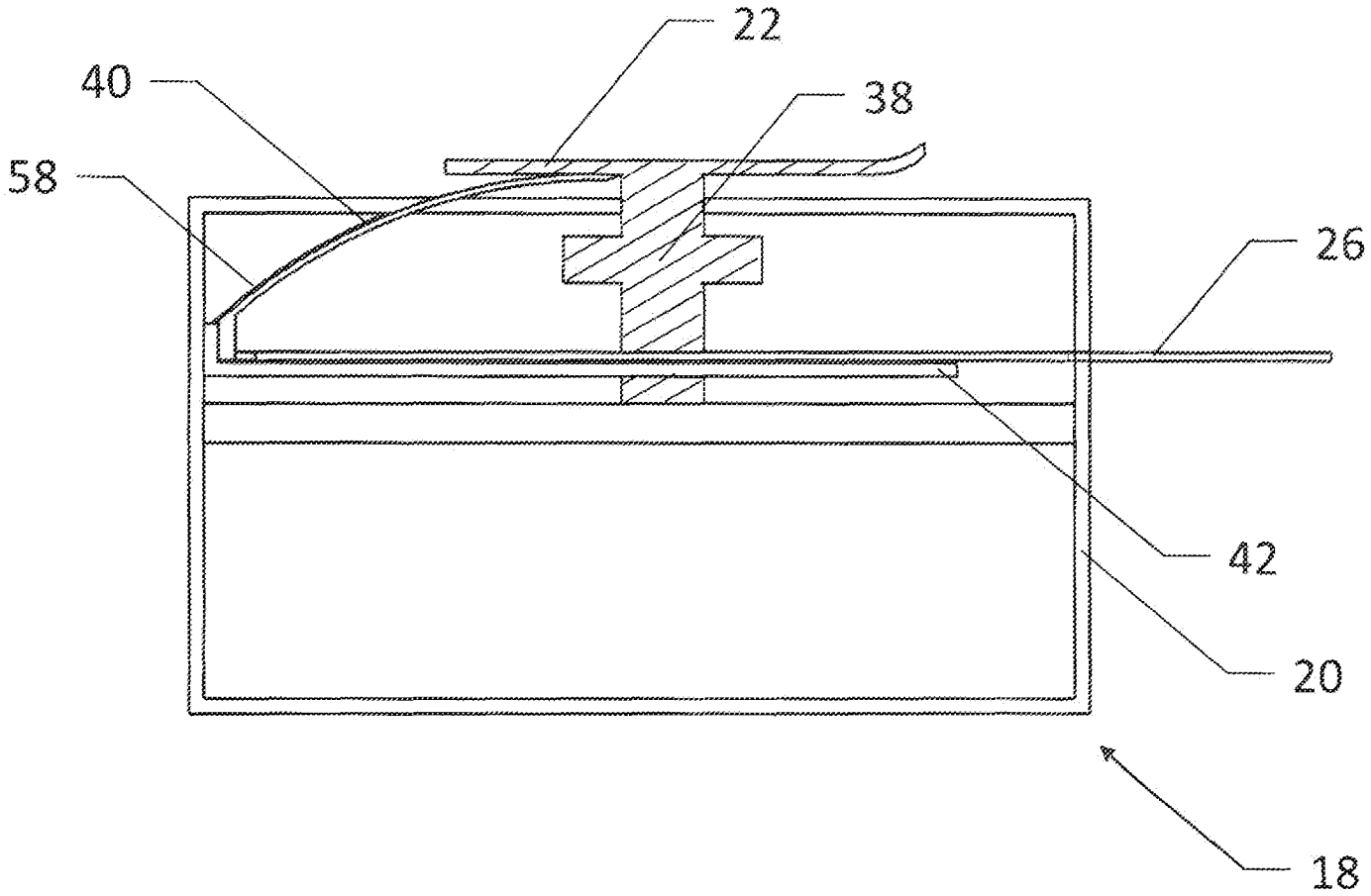
FIG. 6 is a cross section view, showing the blade housing.
Figure 7:
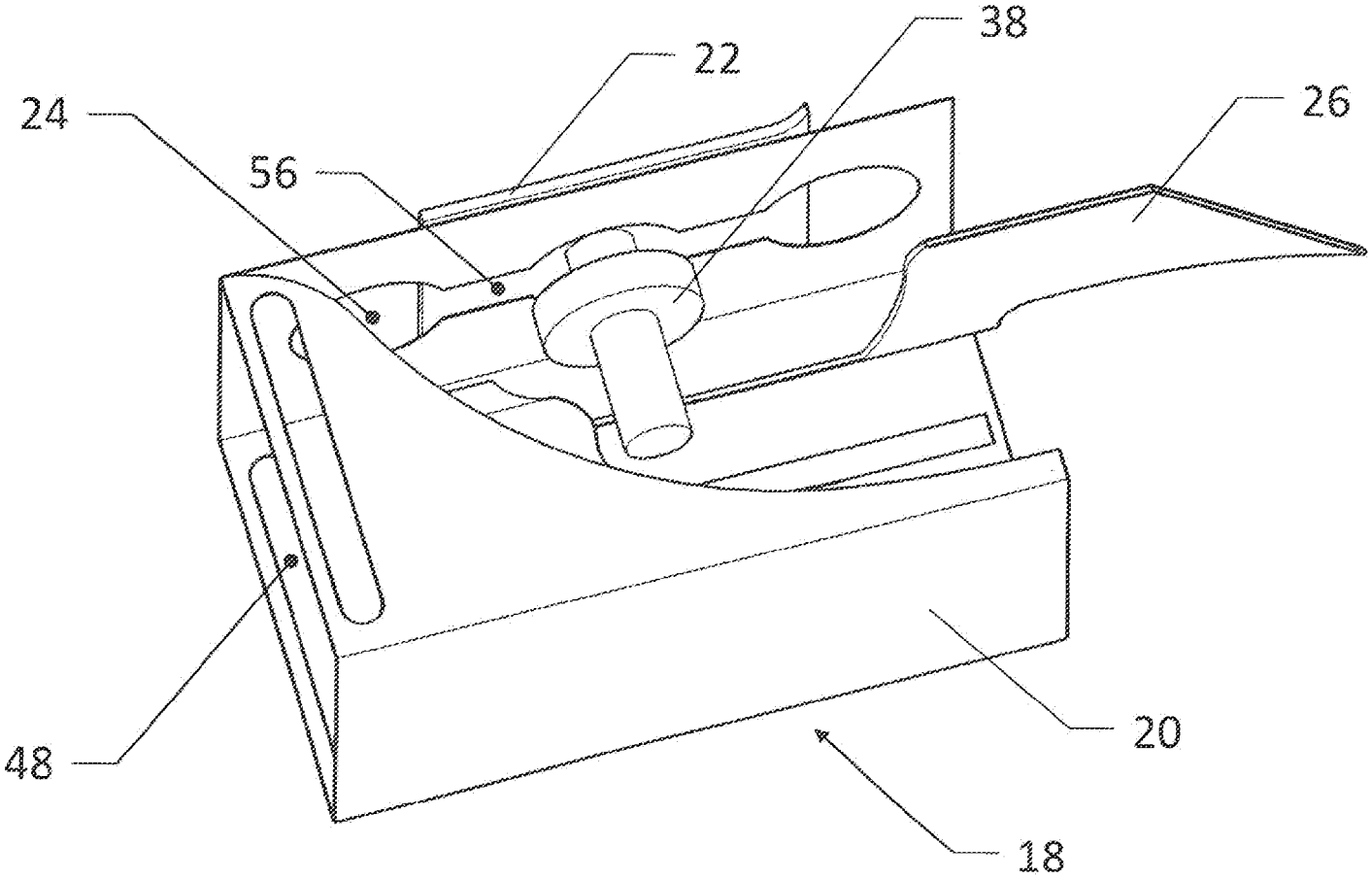
FIG. 7 is a perspective view with the blade housing and blade itself cut away to show the interaction of lock track and lock pole.

One method of extending and retracting blade 26 is illustrated in FIGS. 5-7. However, any known method of providing an extendable and retractable blade can be used in the present invention. The invention should not be limited to the example shown.

An expanded parts view of functional component parts of the blade housing is shown in FIG. 5. Casing (not shown) is removed from the illustration for purposes of clarity. Trigger 22 attaches to a lock pole 38 which has a portion with a small diameter and a portion with a larger diameter. Turning to FIG. 7, a perspective view with casing 20 and blade 26 cut away is shown. The action between trigger 22, lock pole 38 and lock track 24 is illustrated. When trigger 22 is depressed the portion of lock pole 38 with the small diameter is capable of sliding through lock track 24, through channels 56, to reach any position. Channels 56 are designed to correspond with the smaller diameter size of lock pole 38. Upon release of trigger 22, lock pole 38 pops back up into place such that the portion of lock pole 38 with the larger diameter fits into the corresponding desired position of lock track 24. Thus, the lock pole 38 is locked in place (since the portion of lock pole 38 with the larger diameter is incapable of fitting through the narrow channels 56 on lock track 24).

Returning to FIG. 5, pole spring 40 provides resistance for trigger 22 and lock pole 38. The pole spring 40 allows for the depression of lock pole 38 enough for the portion of lock pole 38 with the larger diameter to fit under casing 20 and thereby under the narrow channels 56 along lock track 24 (as illustrated in FIG. 7). For illustration purposes, pole spring 40 is shown larger than would be necessary in order to achieve the spring-like effect. Additionally, pole spring could be attached to the lock pole 38 underneath the casing 20 so as not to interfere with lock track 24.

FIG. 6 is a cross section view of blade housing 18. A positioning slope 58 within casing 20 provides a guide for pole spring 40 which connects trigger 22 and lock pole 38 to blade tray 42. Lock pole 38 engages blade 26, which sits securely in blade tray 42. When trigger 22 is depressed and slid by user, lock pole 38 causes blade 26 and blade tray 42 to shift as well.

In FIG. 7, strap opening 48 is also shown, as a method of attaching casing 20 to sheath 12 (not shown). Note, FIG. 7 is for illustrative purposes to show lock pole 38 and lock track 24 and therefore does not illustrate blade tray, pole spring and several other features of the present method of retracting blade 26.

An alternate embodiment 50 of the present invention is shown in FIG. 8. In the alternate embodiment 50, sheath 12 only covers the user's index finger and thumb. A series of straps 52 connects sheath 12 to wrist portion 28. Thus, the user's other three fingers are left free and exposed. Additionally, an alternate blade housing 54 is illustrated. The alternate blade housing 54 can also operate by a press and slide motion of a trigger 22 along a slide channel 62 located on casing 20. However, as illustrated slide channel 62 is one long thin channel. As further illustrated in FIG. 9 alternate blade housing 54 has a spring 60 housed within casing 20. Lock pole 38, attached to trigger 22, engages spring post 64, blade 26 and blade tray 42. When user engages trigger 22 and slides lock pole 38 along slide channel 62 to expose blade 26, spring post 64 and spring 60 are thrust forward, compressing spring 60. Blade 26 and blade tray 42 move in conjunction with spring post 64, exposing blade 26 outside of casing 20. A partial frictional engagement can be provided such that when the blade 26 is in the fully exposed position, the blade 26 is partially held into place by the frictional engagement (such engagement can be provided in any known manner, such as narrowing of slide channel closer to the front or exit point of blade 26). Upon release of pressure on trigger 22, spring 60 releases tension and pulls blade 26 back within casing 20.

The preceding description contains significant detail regarding the novel aspects of the present invention. It should not be construed, however, as limiting the scope of the invention but rather as providing illustrations of the preferred embodiments of the invention. As an example, the blade housing can provide any known method of providing a trigger which is capable of extending and retracting the blade. Additionally, sheath can consist of a glove-like covering or can merely cover the user's index finger and thumb. Thus, the scope of the invention should be fixed by the following claims, rather than by the examples given.

Having described my invention, I claim:

1. A utility knife device for use by a user having a hand with a thumb and a finger, said utility knife device comprising:

a. a sheath covering at least a portion of said hand of said user;

b. a blade housing surrounding said finger of said user, said blade housing having:

i. a casing attached to said sheath at a connection point;

ii. a blade contained within said casing;

iii. a trigger connected to said blade;

iv. a slide channel on said casing;

v. a blade tray holding said blade;

vi. a lock pole attached to said trigger;

vii. wherein said lock pole engages:

a. a spring post attached to a spring and said casing; and b. said blade and said blade tray;

viii. wherein said trigger is capable of being manipulated to force said spring into a compressed state and said blade tray forward, thereby extending said blade outside of said casing;

ix. wherein when said trigger is released by said user, said spring releases and pulls said spring post and said lock pole to slide backward within said casing, thereby pulling said blade within said casing; and c. wherein said trigger can be adjusted by said user such that said blade extends out of said casing to expose said blade for use.

2. A utility knife device for use by a user having a hand with a thumb and a finger, said utility knife device comprising:

a. a sheath covering at least a portion of said hand of said user;

b. a wrist portion such that said wrist portion connects said sheath to said hand of said user;

c. wherein said sheath covers said thumb and said finger of said user; and wherein said sheath further comprises a series of straps connecting said sheath to said wrist portion d. a blade housing surrounding said finger of said user, said blade housing having:

i. a casing attached to said sheath at a connection point;

ii. a blade contained within said casing;

iii. a trigger connected to said blade;

e. wherein said trigger can be adjusted by said user such that said blade extends out of said casing to expose said blade for use.

3. A utility knife device for use by a user having a hand with a thumb and an index finger, said utility knife device comprising:

a. a sheath covering at least a portion of said hand of said user;

b. a wrist portion such that said wrist portion connects said sheath to said hand of said user;

c. a blade housing surrounding said index finger of said user, said blade housing having:

i. a casing attached to said sheath at a connection point;

ii. a blade contained within said casing;

iii. a trigger connected to said blade;

d. wherein said sheath covers said thumb and said index finger of said user where said blade housing is not present; and wherein said sheath further comprises a series of straps connecting said sheath to said wrist portion; and e. wherein said trigger can be adjusted by said user applying an amount of force upon said trigger such that said blade extends out of said casing to expose said blade for use and automatically retracts when said amount of force is released from said trigger.

* * * * *